US010246965B2

(12) United States Patent
Turley et al.

(10) Patent No.: US 10,246,965 B2
(45) Date of Patent: Apr. 2, 2019

(54) TELEMETRY OPERATED BALL RELEASE SYSTEM

(71) Applicant: Weatherford Technology Holdings, LLC, Houston, TX (US)

(72) Inventors: Rocky A. Turley, Houston, TX (US); Robin L. Campbell, Webster, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 166 days.

(21) Appl. No.: 15/386,929

(22) Filed: Dec. 21, 2016

(65) Prior Publication Data

US 2017/0101844 A1 Apr. 13, 2017

Related U.S. Application Data

(63) Continuation of application No. 14/083,046, filed on Nov. 18, 2013, now Pat. No. 9,528,346.

(51) Int. Cl.
*E21B 23/08* (2006.01)
*E21B 33/12* (2006.01)
(Continued)

(52) U.S. Cl.
CPC ..... *E21B 33/12* (2013.01); *E21B 23/08* (2013.01); *E21B 23/10* (2013.01); *E21B 33/10* (2013.01); *E21B 33/16* (2013.01); *E21B 34/14* (2013.01); *E21B 43/10* (2013.01); *E21B 47/06* (2013.01); *E21B 47/12* (2013.01); *E21B 47/122* (2013.01); *E21B 33/14* (2013.01)

(58) Field of Classification Search
CPC ..... E21B 23/08; E21B 23/10; E21B 34/14; E21B 33/16; E21B 47/12; E21B 33/10
See application file for complete search history.

(56) References Cited

U.S. PATENT DOCUMENTS 2,693,859 A 11/1954 Wright
4,405,017 A 9/1983 Allen et al.
(Continued)

FOREIGN PATENT DOCUMENTS

AU 2013248172 A1 5/2014
GB 2350141 A 11/2000
(Continued)

OTHER PUBLICATIONS

Australian Examination Report dated May 11, 2018, for Australian Patent Application No. 2016253700.
(Continued)

*Primary Examiner* — Brad Harcourt
(74) *Attorney, Agent, or Firm* — Patterson + Sheridan, LLP

(57) ABSTRACT

In one embodiment, a ball release system for use in a wellbore includes a tubular housing, a seat disposed in the housing and comprising arcuate segments arranged to form a ring, each segment radially movable between a catch position for receiving a ball and a release position, a cam disposed in the housing, longitudinally movable relative thereto, and operable to move the seat segments between the positions, an actuator operable to move the cam, and an electronics package disposed in the housing and in communication with the actuator for operating the actuator in response to receiving a command signal.

20 Claims, 7 Drawing Sheets

(51) Int. Cl.

| | |
|---|---|
| ***E21B 33/16*** | (2006.01) |
| ***E21B 47/12*** | (2012.01) |
| ***E21B 33/10*** | (2006.01) |
| ***E21B 23/10*** | (2006.01) |
| ***E21B 34/14*** | (2006.01) |
| ***E21B 43/10*** | (2006.01) |
| ***E21B 47/06*** | (2012.01) |
| *E21B 33/14* | (2006.01) |

(56) References Cited

U.S. PATENT DOCUMENTS

| | | | |
|---|---|---|---|
| 4,583,593 | A | 4/1986 | Zunkel et al. |
| 4,893,678 | A | 1/1990 | Stokley et al. |
| 4,926,938 | A | 5/1990 | Lindsey, Jr. |
| 5,086,843 | A | 2/1992 | Mims et al. |
| 5,086,844 | A | 2/1992 | Mims et al. |
| 5,146,992 | A | 9/1992 | Baugh |
| 5,170,847 | A | 12/1992 | Mims et al. |
| 5,174,375 | A | 12/1992 | Mims et al. |
| 5,360,069 | A | 11/1994 | Schmuck et al. |
| 5,435,390 | A | 7/1995 | Baugh et al. |
| 5,553,667 | A | 9/1996 | Budde et al. |
| 5,560,426 | A | 10/1996 | Trahan et al. |
| 5,590,713 | A | 1/1997 | Baugh et al. |
| 5,787,979 | A | 8/1998 | Giroux et al. |
| 5,813,457 | A | 9/1998 | Giroux et al. |
| 5,833,002 | A | 11/1998 | Holcombe |
| 5,856,790 | A | 1/1999 | Baugh et al. |
| 5,954,133 | A | 9/1999 | Ross |
| 6,009,944 | A | 1/2000 | Gudmestad |
| 6,053,244 | A | 4/2000 | Dybevik et al. |
| 6,053,250 | A | 4/2000 | Echols |
| 6,056,053 | A | 5/2000 | Giroux et al. |
| 6,065,536 | A | 5/2000 | Gudmestad et al. |
| 6,241,018 | B1 | 6/2001 | Eriksen |
| 6,241,023 | B1 | 6/2001 | Krauss et al. |
| 6,244,350 | B1 | 6/2001 | Gudmestad et al. |
| 6,311,771 | B1 | 11/2001 | Gudmestad et al. |
| 6,318,472 | B1 | 11/2001 | Rogers et al. |
| 6,419,015 | B1 | 7/2002 | Budde et al. |
| 6,527,057 | B2 | 3/2003 | Fraser, III et al. |
| 6,561,270 | B1 | 5/2003 | Budde |
| 6,597,175 | B1 | 7/2003 | Brisco |
| 6,634,428 | B2 | 10/2003 | Krauss et al. |
| 6,789,619 | B2 | 9/2004 | Carlson et al. |
| 6,799,638 | B2 | 10/2004 | Butterfield, Jr. |
| 6,848,511 | B1 | 2/2005 | Jones et al. |
| 6,866,100 | B2 | 3/2005 | Gudmestad et al. |
| 6,966,368 | B2 | 11/2005 | Farquhar |
| 7,021,389 | B2 | 4/2006 | Bishop et al. |
| 7,063,148 | B2 | 6/2006 | Jabusch |
| 7,066,256 | B2 | 6/2006 | Dillenbeck et al. |
| 7,114,573 | B2 | 10/2006 | Hirth et al. |
| 7,128,154 | B2 | 10/2006 | Giroux et al. |
| 7,165,622 | B2 | 1/2007 | Hirth et al. |
| 7,182,135 | B2 | 2/2007 | Szarka |
| 7,219,730 | B2 | 5/2007 | Tilton et al. |
| 7,252,152 | B2 | 8/2007 | LoGiudice et al. |
| 7,426,964 | B2 | 9/2008 | Lynde et al. |
| 7,537,060 | B2 | 5/2009 | Fay et al. |
| 7,581,595 | B2 | 9/2009 | Fay et al. |
| 7,584,792 | B2 | 9/2009 | Szarka |
| 7,661,478 | B2 | 2/2010 | Palmer et al. |
| 7,686,092 | B2 | 3/2010 | Szarka |
| 7,766,088 | B2 | 8/2010 | Saucier et al. |
| 7,798,225 | B2 | 9/2010 | Giroux et al. |
| 7,845,400 | B2 | 12/2010 | Smith, Jr. et al. |
| 8,276,665 | B2 | 10/2012 | Webb et al. |
| 8,286,717 | B2 | 10/2012 | Giroux et al. |
| 8,316,951 | B2 | 11/2012 | Fay et al. |
| 8,347,964 | B2 | 1/2013 | Fisher et al. |
| 8,356,671 | B2 | 1/2013 | Guillory et al. |
| 8,479,808 | B2 | 7/2013 | Gouthaman |
| 8,651,174 | B2 | 2/2014 | Barbee et al. |
| 8,668,003 | B2 | 3/2014 | Osmundsen et al. |
| 8,881,824 | B2 | 11/2014 | Stautzenberger |
| 8,997,850 | B2 | 4/2015 | Barbee et al. |
| 9,068,413 | B2 | 6/2015 | Doane |
| 9,068,414 | B2 | 6/2015 | Doane |
| 9,080,404 | B2 | 7/2015 | Kalb et al. |
| 9,121,232 | B2 | 9/2015 | Abraham et al. |
| 9,212,531 | B2 | 12/2015 | Robichaux et al. |
| 9,441,454 | B2 | 9/2016 | Broussard et al. |
| 2003/0230405 | A1 | 12/2003 | Allamon et al. |
| 2005/0006106 | A1 | 1/2005 | Hirth et al. |
| 2007/0272413 | A1 | 11/2007 | Rytlewski et al. |
| 2009/0266544 | A1 | 10/2009 | Redlinger et al. |
| 2009/0272544 | A1 | 11/2009 | Giroux et al. |
| 2010/0038096 | A1 | 2/2010 | Reimert et al. |
| 2010/0051264 | A1 | 3/2010 | Willauer |
| 2010/0181079 | A1 | 7/2010 | Johnson et al. |
| 2011/0000663 | A1 | 1/2011 | Brandsdal |
| 2011/0240311 | A1 | 10/2011 | Robison et al. |
| 2012/0061100 | A1 | 3/2012 | Bræker |
| 2012/0067594 | A1 | 3/2012 | Noske et al. |
| 2013/0118732 | A1* | 5/2013 | Chauffe ..... E21B 34/06 166/250.04 |
| 2013/0146144 | A1 | 6/2013 | Joseph et al. |
| 2013/0299196 | A1 | 11/2013 | Kolle |
| 2013/0327532 | A1 | 12/2013 | Ring et al. |
| 2014/0008083 | A1 | 1/2014 | Ring et al. |
| 2014/0116713 | A1 | 5/2014 | Broussard et al. |
| 2014/0196912 | A1 | 7/2014 | Turley et al. |
| 2014/0262234 | A1 | 9/2014 | Walton et al. |
| 2015/0136393 | A1 | 5/2015 | Turley et al. |
| 2015/0136394 | A1 | 5/2015 | Turley et al. |
| 2015/0136395 | A1 | 5/2015 | Turley et al. |

FOREIGN PATENT DOCUMENTS

| | | | |
|---|---|---|---|
| WO | WO-2012065126 A2 * | 5/2012 | ..... E21B 23/06 |
| WO | 2012/118889 A2 | 9/2012 | |
| WO | 2013/016822 A1 | 2/2013 | |

OTHER PUBLICATIONS

EPO Extended European Search Report dated May 11, 2018, for European Patent Application No. 17208054.1.

EPO Examination Report dated Jan. 23, 2017, for European Patent Application No. 14192237.7.

European Examination Report in related application EP 14192237.7 dated Jan. 23, 2017.

Australian Examination Report in related application AU2014259563 dated Dec. 9, 2015.

Post Allowance Office Action in related application CA 2,869,839 dated Aug. 24, 2017.

* cited by examiner

TELEMETRY OPERATED BALL RELEASE SYSTEM

BACKGROUND OF THE DISCLOSURE

Field of the Disclosure

The present disclosure generally relates to a telemetry operated ball release system.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

A ball seat may be used to facilitate the coupling of liner strings by facilitating pressure increases within a bore of a liner to set a liner hanger in a casing, once a particular pressured is reached within the bore. A ball may be pumped from surface to the seat and pressure may be exerted on the seated ball to achieve a first predetermined pressure that sets a liner hanger. Once the liner hanger has been set, it is necessary to release the ball from the seat to restore circulation. Traditional ball seats use shear type devices to release the ball. Once the liner hanger has been set, then pressure can be increased to a second predetermined pressure which fractures the shear devices and releases the ball to restore circulation in the well. Traditional ball seats, however, suffer from several shortcomings. First, the shear values required to release the ball from the ball seat can vary greatly, and thus, the ball can inadvertently be released at an undesired pressure. Secondly, in some instances, hydrostatic pressure volume can be so great that landing of the ball on the seat is never detected. In such a case, a ball can land on a ball seat and shear so quickly that a pressure spike indicating isolation is never observed.

SUMMARY OF THE DISCLOSURE

In one embodiment, a ball release system for use in a wellbore comprises a tubular housing, a seat disposed in the housing and comprising arcuate segments arranged to form a ring, each segment radially movable between a catch position for receiving a ball and a release position, a cam disposed in the housing, longitudinally movable relative thereto, and operable to move the seat segments between the positions, an actuator operable to move the cam, and an electronics package disposed in the housing and in communication with the actuator for operating the actuator in response to receiving a command signal.

In another embodiment, a liner deployment assembly (LDA) for hanging a liner string from a tubular string cemented in a wellbore comprises a setting tool operable to set a packer of the liner string, a running tool operable to longitudinally and torsionally connect the liner string to an upper portion of the LDA, a stinger connected to the running tool, a packoff for sealing against an inner surface of the liner string and an outer surface of the stinger and for connecting the liner string to a lower portion of the LDA, a release connected to the stinger for disconnecting the packoff from the liner string, a spacer connected to the packoff, and the aforementioned ball release system connected to the spacer.

In another embodiment, a method of hanging an inner tubular string from an outer tubular string comprises running the inner tubular string and a deployment assembly into the wellbore using a deployment string, wherein the deployment assembly comprises a ball release system, pumping a ball down the deployment string to a seat of the ball release system and sending a command signal to the ball release system, and hanging the inner tubular string from the outer tubular string by exerting pressure on the seated ball, wherein the ball release system releases the ball after the inner tubular string is hung.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
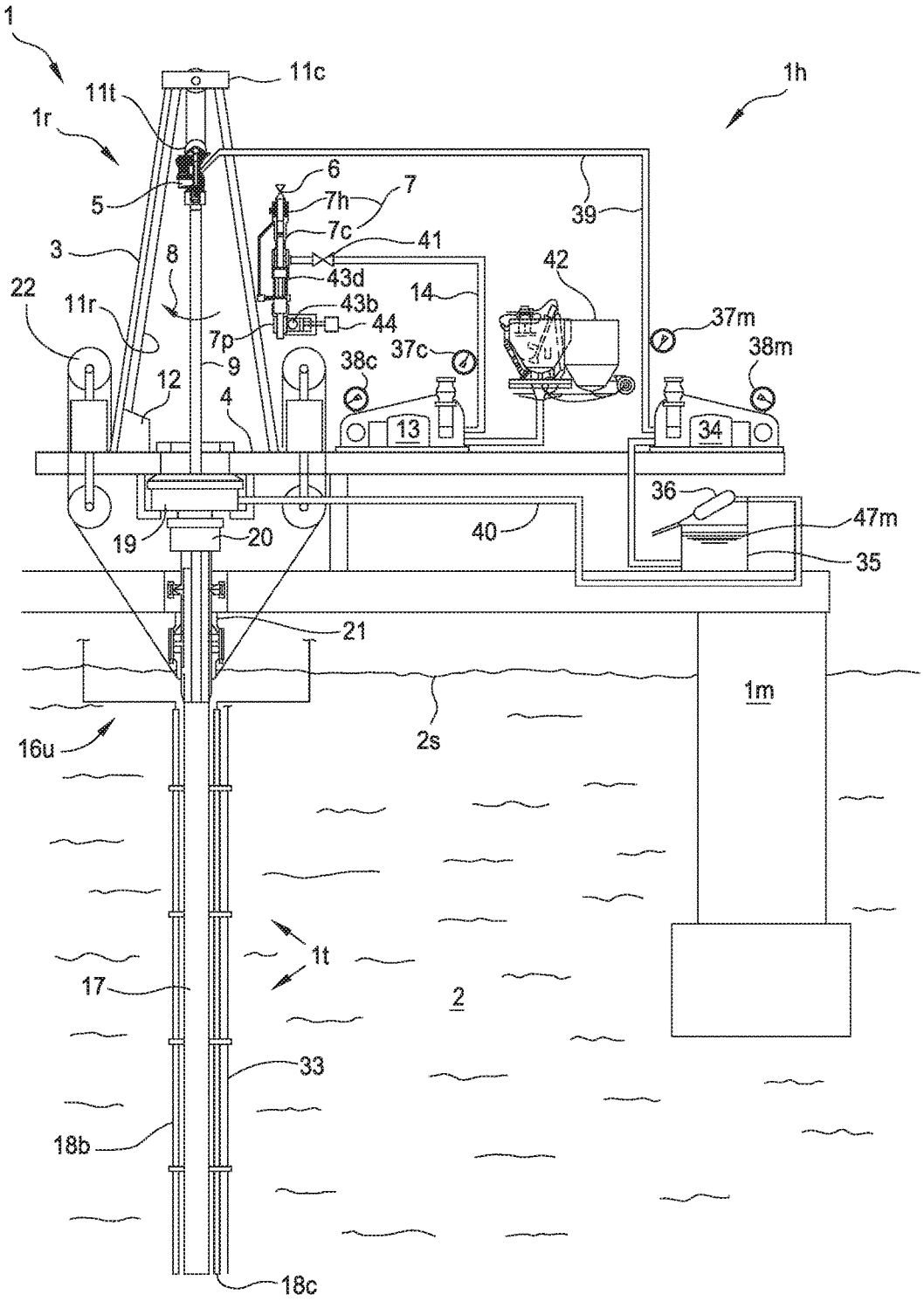
FIGS. 1A-1C illustrate a drilling system in a liner deployment mode, according to one embodiment of this disclosure.
Figure 1B:
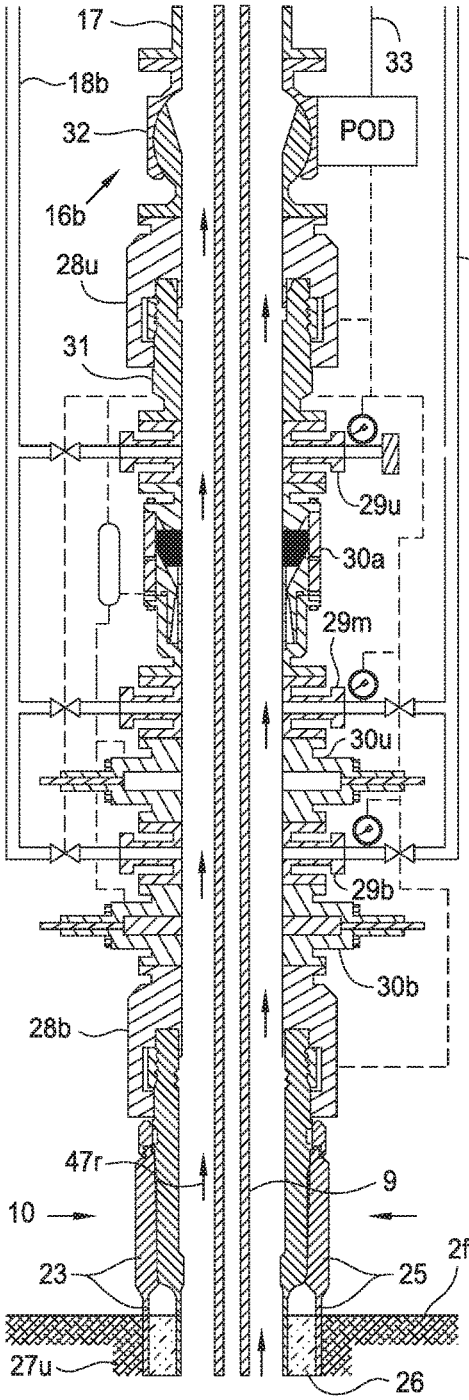
Figure 1C:
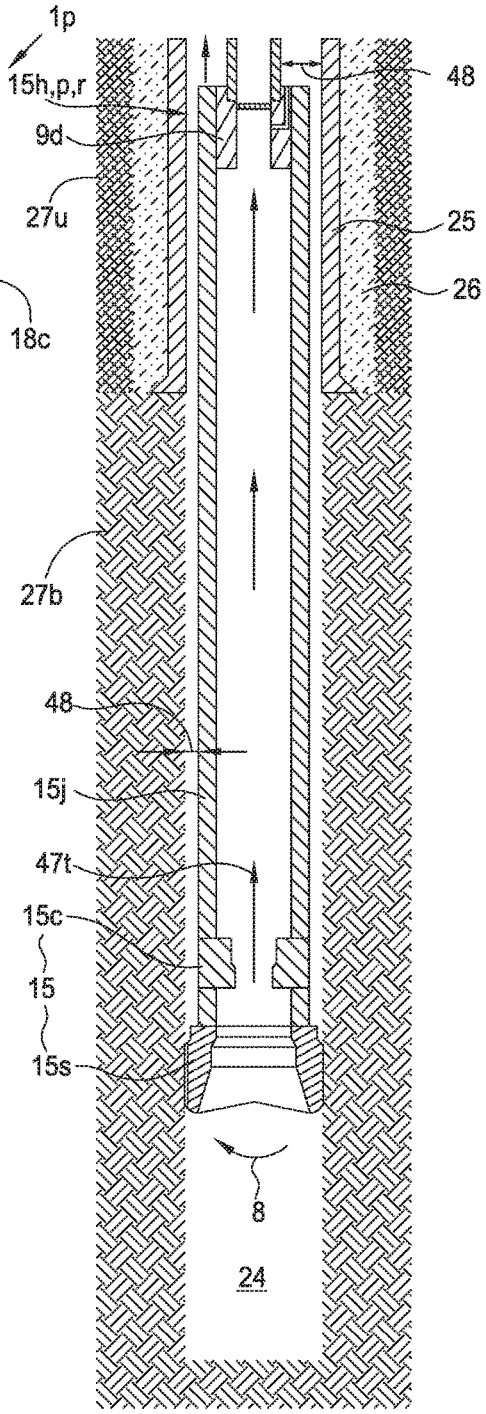

FIGS. 1A-1C illustrate a drilling system 1 in a liner deployment mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system it, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline 2*s*. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, a cementing head 7, and a hoist. The top drive 5 may include a motor for rotating 8 the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block lit of the hoist. The frame of the top drive 5 may be suspended from the derrick 3 by the traveling block lit. The quill may be torsionally driven by the top drive motor and supported from the frame by bearings. The top drive may further have an inlet connected to the frame and in fluid communication with the quill. The traveling block lit may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block lit relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

Figures 2A, 2B, 2C, 2D:
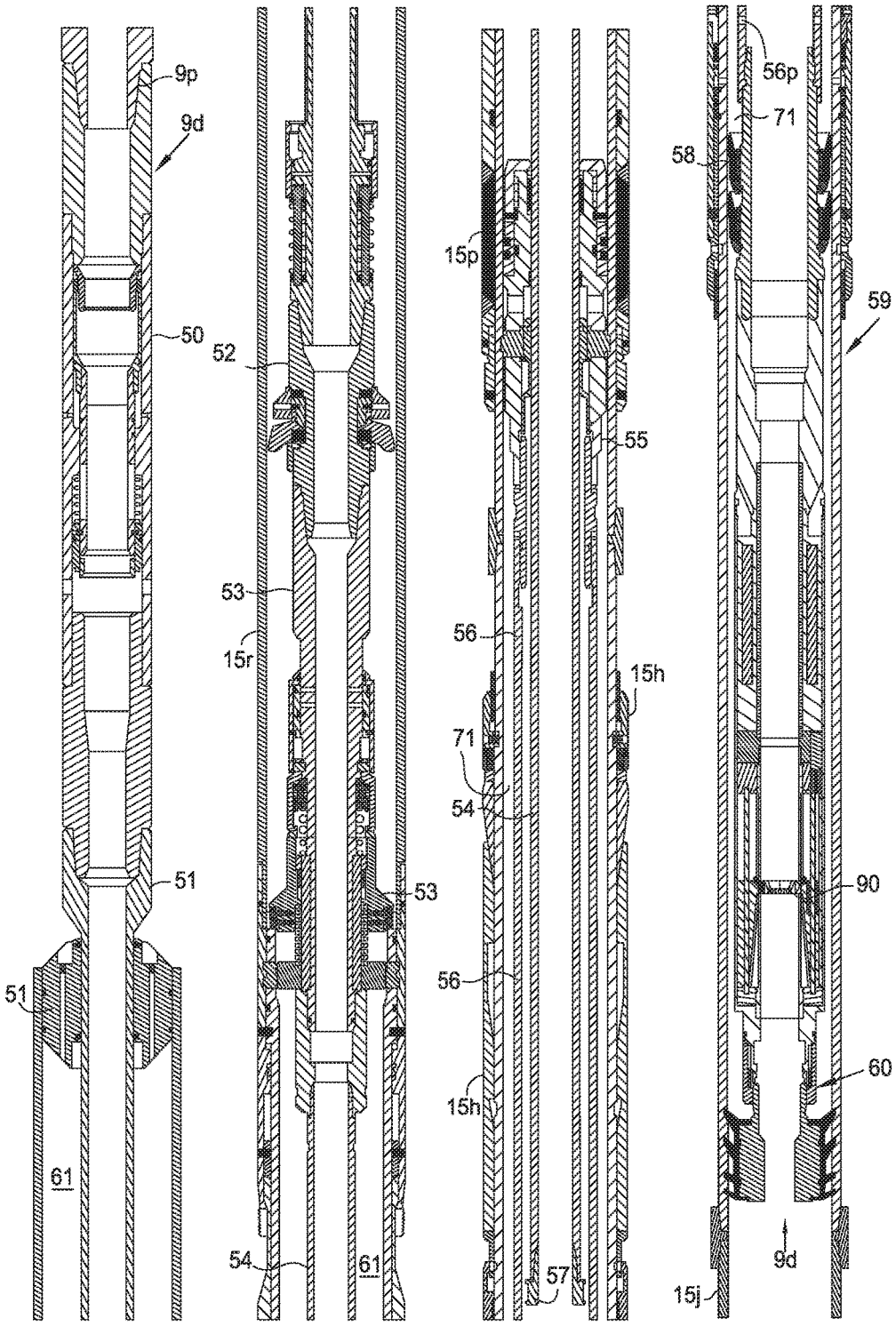
FIGS. 2A-2D illustrate a liner deployment assembly (LDA) of the drilling system, according to one embodiment of this disclosure.

In the deployment mode, an upper end of the workstring 9 may be connected to the top drive quill, such as by threaded couplings. The workstring 9 may include a liner deployment assembly (LDA) 9*d* and a deployment string, such as joints of drill pipe 9*p* (FIG. 2A) connected together, such as by threaded couplings. An upper end of the LDA 9*d* may be connected to a lower end of the drill pipe 9*p*, such as by a threaded connection. The LDA 9*d* may also be connected to a liner string 15. The liner string 15 may include a polished bore receptacle (PBR) 15*r*, a packer 15*p*, a liner hanger 15*h*, joints of liner 15*j*, a float collar 15*c*, and a reamer shoe 15*s*. The liner string members may each be connected together, such as by threaded couplings. The reamer shoe 15*s* may be rotated 8 by the top drive 5 via the workstring 9.

Alternatively, the liner string may include a drillable drill bit (not shown) instead of the reamer shoe 15*s* and the liner string 15 may be drilled into the lower formation, thereby extending the wellbore while deploying the liner string.

Once liner deployment has concluded, the workstring 9 may be disconnected from the top drive and the cementing head 7 may be inserted and connected therebetween. The cementing head 7 may include an isolation valve 6, an actuator swivel 7*h*, a cementing swivel 7*c*, and one or more plug launchers, such as a dart launcher 7*p* and a ball launcher 44. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation 8 of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The seal assembly may include one or more stacks of V-shaped seal rings, such as opposing stacks, disposed between the mandrel and the housing and straddling the inlet-port interface. The actuator swivel 7*h* may be similar to the cementing swivel 7*c* except that the housing may have two inlets in fluid communication with respective passages formed through the mandrel. The mandrel passages may extend to respective outlets of the mandrel for connection to respective hydraulic conduits (only one shown) for operating respective hydraulic actuators of the launchers 7*p*, 44. The actuator swivel inlets may be in fluid communication with a hydraulic power unit (HPU, not shown).

Alternatively, the seal assembly may include rotary seals, such as mechanical face seals.

The dart launcher 7*p* may include a body, a diverter, a canister, a latch, and the actuator. The body may be tubular and may have a bore therethrough. To facilitate assembly, the body may include two or more sections connected together, such as by threaded couplings. An upper end of the body may be connected to a lower end of the actuator swivel, such as by threaded couplings and a lower end of the body may be connected to the workstring 9. The body may further have a landing shoulder formed in an inner surface thereof. The canister and diverter may each be disposed in the body bore. The diverter may be connected to the body, such as by threaded couplings. The canister may be longitudinally movable relative to the body. The canister may be tubular and have ribs formed along and around an outer surface thereof. Bypass passages may be formed between the ribs. The canister may further have a landing shoulder formed in a lower end thereof corresponding to the body landing shoulder. The diverter may be operable to deflect fluid received from a cement line 14 away from a bore of the canister and toward the bypass passages. A release plug, such as dart 43*d*, may be disposed in the canister bore.

The latch may include a body, a plunger, and a shaft. The latch body may be connected to a lug formed in an outer surface of the launcher body, such as by threaded couplings. The plunger may be longitudinally movable relative to the latch body and radially movable relative to the launcher body between a capture position and a release position. The plunger may be moved between the positions by interaction, such as a jackscrew, with the shaft. The shaft may be longitudinally connected to and rotatable relative to the latch body. The actuator may be a hydraulic motor operable to rotate the shaft relative to the latch body.

The ball launcher 44 may include a body, a plunger, an actuator, and a setting plug, such as a ball 43*b*, loaded therein. The ball launcher body may be connected to another lug formed in an outer surface of the dart launcher body, such as by threaded couplings. The ball 43*b* may be disposed in the plunger for selective release and pumping downhole through the drill pipe 9*p* to the LDA 9*d*. The plunger may be movable relative to the respective dart launcher body between a captured position and a release position. The plunger may be moved between the positions by the actuator. The actuator may be hydraulic, such as a piston and cylinder assembly.

Alternatively, the actuator swivel and launcher actuators may be pneumatic or electric. Alternatively, the launcher actuators may be linear, such as piston and cylinders.

In operation, when it is desired to launch one of the plugs 43*b,d*, the HPU may be operated to supply hydraulic fluid to the appropriate launcher actuator via the actuator swivel 7*h*. The selected launcher actuator may then move the plunger to the release position (not shown). If the dart launcher 7*p* is selected, the canister and dart 43*d* may then move downward relative to the housing until the landing shoulders engage. Engagement of the landing shoulders may close the canister bypass passages, thereby forcing fluid to flow into the canister bore. The fluid may then propel the dart 43*d* from the canister bore into a lower bore of the housing and onward through the workstring 9. If the ball launcher 44 was selected, the plunger may carry the ball 43*b* into the launcher housing to be propelled into the drill pipe 9*p* by the fluid.

In operation, the HPU may be operated to supply hydraulic fluid to the actuator via the actuator swivel 7*h*. The actuator may then move the plunger to the release position (not shown). The canister and cementing plug 43*d* may then move downward relative to the housing until the landing shoulders engage. Engagement of the landing shoulders may close the canister bypass passages, thereby forcing fluid to flow into the canister bore. The fluid may then propel the dart 43*d* from the canister bore into a lower bore of the housing and onward through the workstring 9.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 19, such as by a flanged connection. The diverter 19 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14; mud line 39, return line 40, and a cement mixer 42. The drilling fluid 47*m* may include a base liquid. The base liquid may be refined or synthetic oil, water, brine, or a water/oil emulsion. The drilling fluid 47*m* may further include solids dissolved or suspended in the base liquid, such as organophilic clay, lignite, and/or asphalt, thereby forming a mud.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The pressure gauge 37*m* may be assembled as part of the mud line 39. An upper end of the cement line 14 may be connected to the cementing swivel inlet and a lower end of the cement line may be connected to an outlet of the cement pump 13. A shutoff valve 41 and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The workstring 9 may be rotated 8 by the top drive 5 and lowered by the traveling block lit, thereby reaming the liner string 15 into the lower formation 27*b*. Drilling fluid in the wellbore 24 may be displaced through courses of the reamer shoe 15*s*, where the fluid may circulate cuttings away from the shoe and return the cuttings into a bore of the liner string 15. The returns 47*r* (drilling fluid plus cuttings) may flow up the liner bore and into a bore of the LDA 9*d*. The returns 47*r* may flow up the LDA bore and to a diverter valve 50 (FIG. 2A) thereof. The returns 47*r* may be diverted into an annulus 48 formed between the workstring 9/liner string 15 and the casing string 25/wellbore 24 by the diverter valve 50. The returns 47*r* may exit the wellbore 24 and flow into an annulus formed between the riser 17 and the drill pipe 9*p* via an annulus of the LMRP 16*b*, BOP stack, and wellhead 10. The returns 47*r* may exit the riser and enter the return line 40 via an annulus of the UMRP 16*u* and the diverter 19. The returns 47*r* may flow through the return line 40 and into the shale shaker inlet. The returns 47*r* may be processed by the shale shaker 36 to remove the cuttings.

FIGS. 2A-2D illustrate the liner deployment assembly LDA 9*d*. The LDA 9*d* may include a diverter valve 50, a junk bonnet 51, a setting tool 52, running tool 53, a stinger 54, an upper packoff 55, a spacer 56, a release 57, a lower packoff 58, a ball release system 59, and a plug release system 60.

An upper end of the diverter valve 50 may be connected to a lower end the drill pipe 9*p* and a lower end of the diverter valve 50 may be connected to an upper end of the junk bonnet 51, such as by threaded couplings. A lower end of the junk bonnet 51 may be connected to an upper end of the setting tool 52 and a lower end of the setting tool may be connected to an upper end of the running tool 53, such as by threaded couplings. The running tool 53 may also be fastened to the packer 15*p*. An upper end of the stinger 54 may be connected to a lower end of the running tool 53 and a lower end of the stringer may be connected to the release 57, such as by threaded couplings. The stinger 54 may extend through the upper packoff 55. The upper packoff 55 may be fastened to the packer 15*p*. An upper end of the spacer 56 may be connected to a lower end of the upper packoff 55, such as by threaded couplings. An upper end of the lower packoff 58 may be connected to a lower end of the spacer 56, such as by threaded couplings. An upper end of the ball release system 59 may be connected to a lower end of the lower packoff 58, such as by threaded couplings. An upper end of the plug release system 60 may be connected to a lower end of the ball release system 59 such as by threaded couplings.

The diverter valve 50 may include a housing, a bore valve, and a port valve. The diverter housing may include two or more tubular sections (three shown) connected to each other, such as by threaded couplings. The diverter housing may have threaded couplings formed at each longitudinal end thereof for connection to the drill pipe 9*p* at an upper end thereof and the junk bonnet 51 at a lower end thereof. The bore valve may be disposed in the housing. The bore valve may include a body and a valve member, such as a flapper, pivotally connected to the body and biased toward a closed position, such as by a torsion spring. The flapper may be oriented to allow downward fluid flow from the drill pipe 9*p* through the rest of the LDA 9*d* and prevent reverse upward flow from the LDA to the drill pipe 9*p*. Closure of the flapper may isolate an upper portion of a bore of the diverter valve from a lower portion thereof. Although not shown, the body may have a fill orifice formed through a wall thereof and bypassing the flapper.

The diverter port valve may include a sleeve and a biasing member, such as a compression spring. The sleeve may include two or more sections (four shown) connected to each other, such as by threaded couplings and/or fasteners. An upper section of the sleeve may be connected to a lower end of the bore valve body, such as by threaded couplings. Various interfaces between the sleeve and the housing and between the housing sections may be isolated by seals. The sleeve may be disposed in the housing and longitudinally movable relative thereto between an upper position and a lower position. The sleeve may be stopped in the lower position against an upper end of the lower housing section and in the upper position by the bore valve body engaging a lower end of the upper housing section. The mid housing section may have one or more flow ports and one or more equalization ports formed through a wall thereof. One of the sleeve sections may have one or more equalization slots formed therethrough providing fluid communication between a spring chamber formed in an inner surface of the mid housing section and the lower bore portion of the diverter valve 50.

One of the sleeve sections may cover the housing flow ports when the sleeve is in the lower position, thereby closing the housing flow ports and the sleeve section may be clear of the flow ports when the sleeve is in the upper position, thereby opening the flow ports. In operation, surge pressure of the returns 47*r* generated by deployment of the LDA 9*d* and liner string 15 into the wellbore may be exerted on a lower face of the closed flapper. The surge pressure may push the flapper upward, thereby also pulling the sleeve upward against the compression spring and opening the housing flow ports. The surging returns 47*r* may then be diverted through the open flow ports by the closed flapper. Once the liner string 15 has been deployed, dissipation of the surge pressure may allow the spring to return the sleeve to the lower position.

The junk bonnet 51 may include a piston, a mandrel, and a release valve. Although shown as one piece, the mandrel may include two or more sections connected to each other, such as by threaded couplings and/or fasteners. The mandrel may have threaded couplings formed at each longitudinal end thereof for connection to the diverter valve 50 at an upper end thereof and the setting tool 52 at a lower end thereof.

The piston may be an annular member having a bore formed therethrough. The mandrel may extend through the piston bore and the piston may be longitudinally movable relative thereto subject to entrapment between an upper shoulder of the mandrel and the release valve. The piston may carry one or more (two shown) outer seals and one or more (two shown) inner seals. Although not shown, the junk bonnet 51 may further include a split seal gland carrying each piston inner seal and a retainer for connecting the each seal gland to the piston, such as by a threaded connection. The inner seals may isolate an interface between the piston and the mandrel.

The piston may also be disposed in a bore of the PBR 15*r* adjacent an upper end thereof and be longitudinally movable relative thereto. The outer seals may isolate an interface between the piston and the PBR 15*r*, thereby forming an upper end of a buffer chamber 61. A lower end of the buffer chamber 61 may be formed by a sealed interface between the upper packoff 55 and the packer 15*p*. The buffer chamber 61 may be filled with a hydraulic fluid (not shown), such as fresh water or oil, such that the piston may be hydraulically locked in place. The buffer chamber 61 may prevent infiltration of debris from the wellbore 24 from obstructing operation of the LDA 9*d*. The piston may include a fill passage extending longitudinally therethrough closed by a plug. The mandrel may include a bypass groove formed in and along an outer surface thereof. The bypass groove may create a leak path through the piston inner seals during removal of the LDA 9*d* from the liner string 15 to release the hydraulic lock.

The release valve may include a shoulder formed in an outer surface of the mandrel, a closure member, such as a sleeve, and one or more biasing members, such as compression springs. Each spring may be carried on a rod and trapped between a stationary washer connected to the rod and a washer slidable along the rod. Each rod may be disposed in a pocket formed in an outer surface of the mandrel. The sleeve may have an inner lip trapped formed at a lower end thereof and extending into the pockets. The lower end may also be disposed against the slidable washer. The valve shoulder may have one or more one or more radial ports formed therethrough. The valve shoulder may carry a pair of seals straddling the radial ports and engaged with the valve sleeve, thereby isolating the mandrel bore from the buffer chamber 61.

The piston may have a torsion profile formed in a lower end thereof and the valve shoulder may have a complementary torsion profile formed in an upper end thereof. The piston may further have reamer blades formed in an upper surface thereof. The torsion profiles may mate during removal of the LDA 9*d* from the liner string 15, thereby torsionally connecting the piston to the mandrel. The piston may then be rotated during removal to back ream debris accumulated adjacent an upper end of the PBR 15*r*. The piston lower end may also seat on the valve sleeve during removal. Should the bypass groove be clogged, pulling of the drill pipe 9*p* may cause the valve sleeve to be pushed downward relative to the mandrel and against the springs to open the radial ports, thereby releasing the hydraulic lock.

Alternatively, the piston may include two elongate hemi-annular segments connected together by fasteners and having gaskets clamped between mating faces of the segments to inhibit end-to-end fluid leakage. Alternatively, the piston may have a radial bypass port formed therethrough at a location between the upper and lower inner seals and the bypass groove may create the leak path through the lower inner seal to the bypass port. Alternatively, the valve sleeve may be fastened to the mandrel by one or more shearable fasteners.

The setting tool 52 may include a body, a plurality of fasteners, such as dogs, and a rotor. Although shown as one piece, the body may include two or more sections connected to each other, such as by threaded couplings and/or fasteners. The body may have threaded couplings formed at each longitudinal end thereof for connection to the junk bonnet 51 at an upper end thereof and the running tool 53 at a lower end thereof. The body may have a recess formed in an outer surface thereof for receiving the rotor. The rotor may include a thrust ring, a thrust bearing, and a guide ring. The guide ring and thrust bearing may be disposed in the recess. The thrust bearing may have an inner race torsionally connected to the body, such as by press fit, an outer race torsionally connected to the thrust ring, such as by press fit, and a rolling element disposed between the races. The thrust ring may be connected to the guide ring, such as by one or more threaded fasteners. An upper portion of a pocket may be formed between the thrust ring and the guide ring. The setting tool 52 may further include a retainer ring connected to the body adjacent to the recess, such as by one or more threaded fasteners. A lower portion of the pocket may be formed between the body and the retainer ring. The dogs may be disposed in the pocket and spaced around the pocket.

Each dog may be movable relative to the rotor and the body between a retracted position and an extended position. Each dog may be urged toward the extended position by a biasing member, such as a compression spring. Each dog may have an upper lip, a lower lip, and an opening. An inner end of each spring may be disposed against an outer surface of the guide ring and an outer portion of each spring may be received in the respective dog opening. The upper lip of each dog may be trapped between the thrust ring and the guide ring and the lower lip of each dog may be trapped between the retainer ring and the body. Each dog may also be trapped between a lower end of the thrust ring and an upper end of the retainer ring. Each dog may also be torsionally connected to the rotor, such as by a pivot fastener (not shown) received by the respective dog and the guide ring.

The running tool 53 may include a body, a lock, a clutch, and a latch. The body may include two or more tubular sections (two shown) connected to each other, such as by threaded couplings. The body may have threaded couplings formed at each longitudinal end thereof for connection to the setting tool 52 at an upper end thereof and the stinger 54 at a lower end thereof. The latch may longitudinally and torsionally connect the liner string 15 to an upper portion of the LDA 9*d*. The latch may include a thrust cap having one or more torsional fasteners, such as keys, and a longitudinal fastener, such as a floating nut. The keys may mate with a torsional profile formed in an upper end of the packer 15*p* and the floating nut may be screwed into threaded dogs of the packer. The lock may be disposed on the body to prevent premature release of the latch from the liner string 15. The clutch may selectively torsionally connect the thrust cap to the body.

The lock may include a piston, a plug, one or more fasteners, such as dogs, and a sleeve. The plug may be connected to an outer surface of the body, such as by threaded couplings. The plug may carry an inner seal and an outer seal. The inner seal may isolate an interface formed between the plug and the body and the outer seal may isolate an interface formed between the plug and the piston. The piston may have an upper portion disposed along an outer surface of the body and an enlarged lower portion disposed along an outer surface of the plug. The piston may carry an inner seal in the upper portion for isolating an interface formed between the body and the piston. The piston may be fastened to the body, such as by one or more shearable fasteners. An actuation chamber may be formed between the piston, plug, and body. The body may have one or more ports formed through a wall thereof providing fluid communication between the chamber and a bore of the body.

The lock sleeve may have an upper portion disposed along an outer surface of the body and extending into the piston lower portion and an enlarged lower portion. The lock sleeve may have one or more openings formed therethrough and spaced around the sleeve to receive a respective dog therein. Each dog may extend into a groove formed in an outer surface of the body, thereby fastening the lock sleeve to the body. A thrust bearing may be disposed in the lock sleeve lower portion and against a shoulder formed in an outer surface of the body. The thrust bearing may be biased against the body shoulder by a compression spring.

The body may have a torsional profile, such as one or more keyways formed in an outer surface thereof adjacent to a lower end of the upper body section. A key may be disposed in each of the keyways. A lower end of the compression spring may bear against the keyways.

The thrust cap may be linked to the lock sleeve, such as by a lap joint. The latch keys may be connected to the thrust cap, such as by one or more threaded fasteners. A shoulder may be formed in an inner surface of the thrust cap dividing an upper enlarged portion from a lower enlarged portion of the thrust cap. The shoulder and enlarged lower portion may receive an upper portion of a biasing member, such as a compression spring. A lower end of the compression spring may be received by a shoulder formed in an upper end of the float nut.

The float nut may be urged against a shoulder formed by an upper end of the lower housing section by the compression spring. The float nut may have a thread formed in an outer surface thereof. The thread may be opposite-handed, such as left handed, relative to the rest of the threads of the workstring 9. The float nut may be torsionally connected to the body by having one or more keyways formed along an inner surface thereof and receiving the keys, thereby providing upward freedom of the float nut relative to the body while maintaining torsional connection.

The clutch may include a gear and a lead nut. The gear may be formed by one or more teeth connected to the thrust cap, such as by a threaded fastener. The teeth may mesh with the keys, thereby torsionally connecting the thrust cap to the body. The lead nut may be disposed in a threaded passage formed in an inner surface of the thrust cap upper enlarged portion and have a threaded outer surface meshed with the thrust cap thread, thereby longitudinally connecting the lead nut and thrust cap while providing torsional freedom therebetween. The lead nut may be torsionally connected to the body by having one or more keyways formed along an inner surface thereof and receiving the keys, thereby providing longitudinal freedom of the lead nut relative to the body while maintaining torsional connection. Threads of the lead nut and thrust cap may have a finer pitch, opposite hand, and greater number than threads of the float nut and packer dogs to facilitate lesser (and opposite) longitudinal displacement per rotation of the lead nut relative to the float nut.

In operation, once the liner hanger 15*h* has been set, the lock may be released by supplying sufficient fluid pressure through the body ports. Weight may then be set down on the liner string, thereby pushing the thrust cap upward and disengaging the clutch gear. The workstring may then be rotated to cause the lead nut to travel down the threaded passage of the thrust cap while the float nut travels upward relative to the threaded dogs of the packer. The float nut may disengage from the threaded dogs before the lead nut bottoms out in the threaded passage. Rotation may continue to bottom out the lead nut, thereby restoring torsional connection between the thrust cap and the body.

Alternatively, the running tool may be replaced by a hydraulically released running tool. The hydraulically released running tool may include a piston, a shearable stop, a torsion sleeve, a longitudinal fastener, such as a collet, a cap, a case, a spring, a body, and a catch. The collet may have a plurality of fingers each having a lug formed at a bottom thereof. The finger lugs may engage a complementary portion of the packer 15*p*, thereby longitudinally connecting the running tool to the liner string 15. The torsion sleeve may have keys for engaging the torsion profile formed in the packer 15*p*. The collet, case, and cap may be longitudinally movable relative to the body subject to limitation by the stop. The piston may be fastened to the body by one or more shearable fasteners and fluidly operable to release the collet fingers when actuated by a threshold release pressure. In operation, fluid pressure may be increased to push the piston and fracture the shearable fasteners, thereby releasing the piston. The piston may then move upward toward the collet until the piston abuts the collet and fractures the stop. The latch piston may continue upward movement while carrying the collet, case, and cap upward until a bottom of the torsion sleeve abuts the fingers, thereby pushing the fingers radially inward. The catch may be a split ring biased radially inward and disposed between the collet and the case. The body may include a recess formed in an outer surface thereof. During upward movement of the piston, the catch may align and enter the recess, thereby preventing reengagement of the fingers. Movement of the piston may continue until the cap abuts a stop shoulder of the body, thereby ensuring complete disengagement of the fingers.

An upper end of an actuation chamber 71 may be formed by the sealed interface between the upper packoff 55 and the packer 15*p*. A lower end of the actuation chamber 71 may be formed by the sealed interface between the lower packoff 58 and the liner hanger 15*h*. The actuation chamber 71 may be in fluid communication with the LDA bore (above the ball release system 59) via one or more ports 56*p* formed through a wall of the spacer 56.

The upper packoff 55 may include a cap, a body, an inner seal assembly, such as a seal stack, an outer seal assembly, such as a cartridge, one or more fasteners, such as dogs, a lock sleeve, an adapter, and a detent. The upper packoff 55 may be tubular and have a bore formed therethrough. The stinger 54 may be received through the packoff bore and an upper end of the spacer 56 may be fastened to a lower end of the upper packoff 55. The upper packoff 55 may be fastened to the packer 15*p* by engagement of the dogs with an inner surface of the packer.

The seal stack may be disposed in a groove formed in an inner surface of the body. The seal stack may be connected to the body by entrapment between a shoulder of the groove and a lower face of the cap. The seal stack may include an upper adapter, an upper set of one or more directional seals, a center adapter, a lower set of one or more directional seals, and a lower adapter. The cartridge may be disposed in a groove formed in an outer surface of the body. The cartridge may be connected to the body by entrapment between a shoulder of the groove and a lower end of the cap. The cartridge may include a gland and one or more (two shown) seal assemblies. The gland may have a groove formed in an outer surface thereof for receiving each seal assembly. Each seal assembly may include a seal, such as an S-ring, and a pair of anti-extrusion elements, such as garter springs.

The body may also carry a seal, such as an O-ring, to isolate an interface formed between the body and the gland. The body may have one or more (two shown) equalization ports formed through a wall thereof located adjacently below the cartridge groove. The body may further have a stop shoulder formed in an inner surface thereof adjacent to the equalization ports. The lock sleeve may be disposed in a bore of the body and longitudinally movable relative thereto between a lower position and an upper position. The lock sleeve may be stopped in the upper position by engagement of an upper end thereof with the stop shoulder and held in the lower position by the detent. The body may have one or more openings formed therethrough and spaced around the body to receive a respective dog therein.

Each dog may extend into a groove formed in an inner surface of the packer 15*p*, thereby fastening a lower portion of the LDA 9*d* to the packer 15*p*. Each dog may be radially movable relative to the body between an extended position (shown) and a retracted position. Each dog may be extended by interaction with a cam profile formed in an outer surface of the lock sleeve. The lock sleeve may further have a taper formed in a wall thereof and collet fingers extending from the taper to a lower end thereof. The detent may include the collet fingers and a complementary groove formed in an inner surface of the body. The detent may resist movement of the lock sleeve from the lower position to the upper position.

The lower packoff 58 may include a body and one or more (two shown) seal assemblies. The body may have threaded couplings formed at each longitudinal end thereof for connection to the spacer 56 at an upper end thereof and ball release system 59 at a lower end thereof. Each seal assembly may include a directional seal, such as cup seal, an inner seal, a gland, and a washer. The inner seal may be disposed in an interface formed between the cup seal and the body. The gland may be fastened to the body, such as a by a snap ring. The cup seal may be connected to the gland, such as molding or press fit. An outer diameter of the cup seal may correspond to an inner diameter of the liner hanger 15*h*, such as being slightly greater than the inner diameter. The cup seal may oriented to sealingly engage the liner hanger inner surface in response to pressure in the LDA bore being greater than pressure in the liner string bore (below the liner hanger).

The plug release system 60 may include a launcher and the cementing plug, such as a wiper plug. The launcher may include a housing having a threaded coupling formed at an upper end thereof for connection to the lower end of the ball release system 59 and a portion of a latch. The wiper plug may include a body and a wiper seal. The body may have a portion of a latch, such as an outer profile, engaged with the launcher latch portion, thereby fastening the plug to the launcher. The plug body may further have a landing profile formed in an inner surface thereof. The landing profile may have a landing shoulder, an inner latch profile, and a seal bore for receiving the dart 43*d*. The dart 43*d* may have a complementary landing shoulder, landing seal, and a fastener for engaging the inner latch profile, thereby connecting the dart and the wiper plug 60*b*. The plug body may be made from a drillable material, such as cast iron, nonferrous metal or alloy, fiber reinforced composite, or engineering polymer, and the wiper seal may be made from an elastomer or elastomeric copolymer.

Figure 3A:
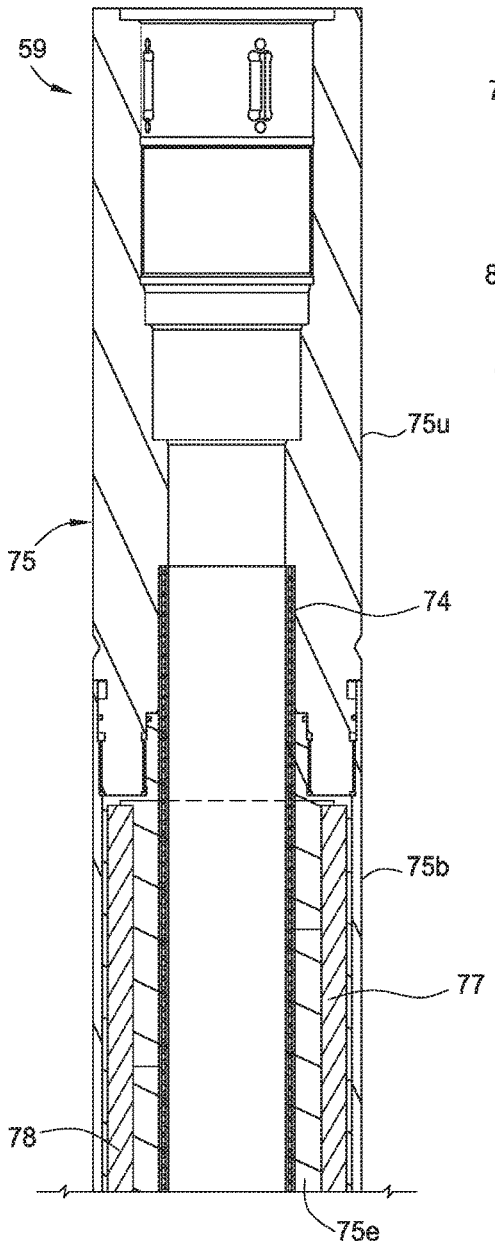
FIGS. 3A and 3B illustrate a ball release system of the LDA.
Figure 3B:
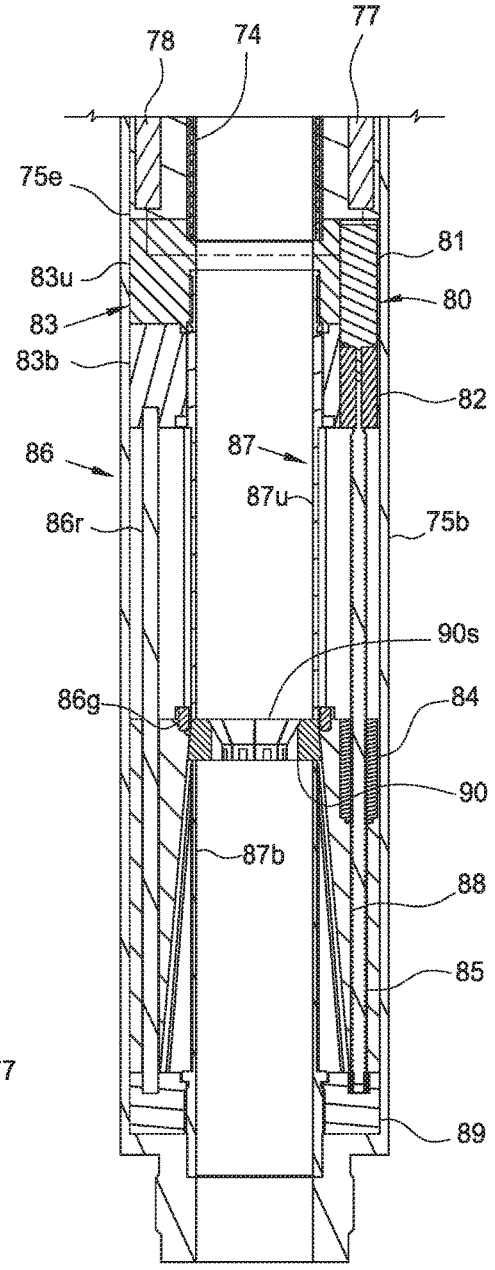

FIGS. 3A and 3B illustrate the ball release system 59. The ball release system 59 may include a housing 75, an antenna 74, an electronics package 77, a power source, such as a battery 78, an actuator 80, and a ball seat 90. The housing 75 may have a bore formed therethrough and include two or more tubular sections, such as an upper section 75*u*, a lower section 75*b*, and an electronics section 75*e*, connected together, such as by threaded couplings. The housing 75 may also have threaded couplings formed at each longitudinal end thereof for connection to the lower packoff 58 at an upper end thereof and the plug release system 60 at a lower end thereof.

Alternatively, the power source may be a capacitor or inductor instead of the battery 78.

The antenna 74 may be tubular and extend along an inner surface of the upper 75*u* and electronics 75*e* housing sections. The antenna 74 may include an inner liner, a coil, and a jacket. The antenna liner may be made from a non-magnetic and non-conductive material, such as a polymer or composite, have a bore formed longitudinally therethrough, and have a helical groove formed in an outer surface thereof. The antenna coil may be wound in the helical groove and made from an electrically conductive material, such as copper or alloy thereof. The antenna jacket may be made from the non-magnetic and non-conductive material and may insulate the coil. The antenna 74 may be received in a recess formed in an inner surface of the housing 75 between a shoulder formed in an inner surface of the upper 75*u* housing section and a shoulder of the actuator 80.

The electronics housing 75*e* may have one or more (two shown) pockets formed in an outer surface thereof. The electronics package 77 and battery 78 may be disposed in respective pockets of the electronics housing 75*e*. The electronics housing 75*e* may have an electrical conduit formed through a wall thereof for receiving lead wires connecting the antenna 74 to the electronics package 77 and connecting the actuator 80 to the electronics package. The electronics package 77 may include a control circuit, a transmitter, a receiver, and a motor controller integrated on a printed circuit board. The control circuit may include a microcontroller (MCU), a memory unit (MEM), a clock, and an analog-digital converter. The transmitter may include an amplifier (AMP), a modulator (MOD), and an oscillator (OSC). The receiver may include an amplifier (AMP), a demodulator (MOD), and a filter (FIL). The motor controller may include a power converter for converting a DC power signal supplied by the battery 78 into a suitable power signal for driving an electric motor 81 of the actuator 80. The electronics package 77 may be housed in an encapsulation.

Figure 1D:
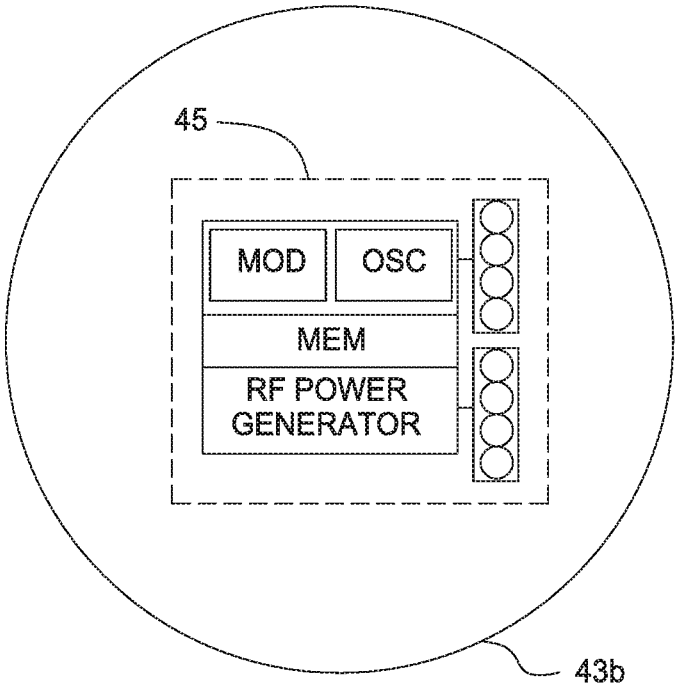
FIG. 1D illustrates ball having a radio frequency identification tag (RFID) of the drilling system.

FIG. 1D illustrates the ball 43*b*. The ball 43*b* may be made from a polymer, such as an engineering polymer or polyphenol. The ball 43*b* may have a radio frequency identification (RFID) tag 45 embedded in a periphery thereof. The RFID tag 45 may be a passive tag and include an electronics package and one or more antennas housed in an encapsulation. The electronics package may include a memory unit, a transmitter, and a radio frequency (RF) power generator for operating the transmitter. The RFID tag 45 may be programmed with a command addressed to the ball release system 59. The RFID tag 45 may be operable to transmit a wireless command signal (FIG. 4A) 49*c*, such as a digital electromagnetic command signal, to the antenna 74 in response to receiving an activation signal 49*a* therefrom. The MCU of the control circuit may receive the command signal 49*c* and operate the actuator 80 in response to receiving the command signal.

Figure 1E:
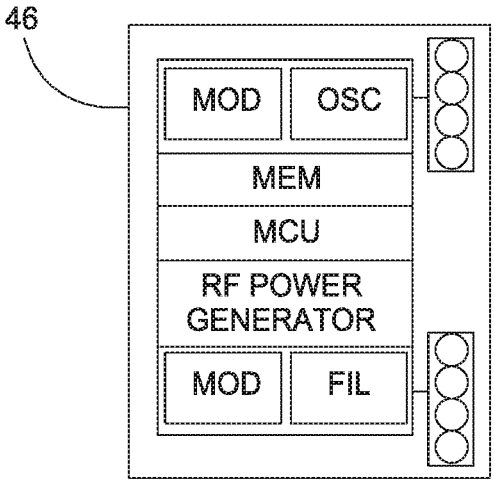
FIG. 1E illustrates an alternative RFID tag.

FIG. 1E illustrates an alternative RFID tag 46. Alternatively, the RFID tag 45 may instead be a wireless identification and sensing platform (WISP) RFID tag 46. The WISP tag 46 may further a microcontroller (MCU) and a receiver for receiving, processing, and storing data from the ball release system 59. Alternatively, the RFID tag may be an active tag having an onboard battery powering a transmitter instead of having the RF power generator or the WISP tag may have an onboard battery for assisting in data handling functions. The active tag may further include a safety, such as pressure switch, such that the tag does not begin to transmit until the tag is in the wellbore.

Returning to FIGS. 3A and 3B, the actuator 80 may include the electric motor 81, a gear, such as planetary gear 82, a body 83, a lead nut 84, a lead screw 85, a guide 86, a mandrel 87, a cam 88, and a shoe 89. The actuator 80 may be disposed in a chamber formed in the lower housing section 75*b* and disposed between a lower end of the electronics housing 75*e* and a shoulder formed in an inner surface of the lower housing section, thereby longitudinally connecting the actuator to the housing 75. The actuator 80 may also be pressed between the lower end and the shoulder or interference fit against the inner surface of the lower housing section 75*b*, thereby torsionally connecting the actuator to the housing 75. Alternatively, the actuator 80 may be fastened to the lower housing section for torsional connection.

The body 83 may include one or more sections, such as an upper section 83*u* and a lower section 83*b*, connected together, such as by a splice joint. The mandrel 87 may include one or more sections, such as an upper section 87*u* and a lower section 87*b*. The upper mandrel section 87*u* may be connected to the upper body section 83*u*, such as by threaded couplings. The motor 81 and planetary gear 82 may be disposed in a pocket formed in an outer surface of the body 83. The motor 81 may include a stator in electrical communication with the motor controller and a rotor in electromagnetic communication with the stator for being driven thereby. The rotor may be torsionally connected to a drive shaft of the motor 81. The planetary gear 82 may torsionally connect the motor drive shaft to an upper end of the lead screw 85 while also radially supporting the lead screw upper end for rotation relative to the body 83 and providing mechanical advantage. Alternatively, a radial bearing may be used instead of the planetary gear such that the motor directly drives the lead screw.

The guide 86 may include a rod 86*r* and a ring 86*g*. An upper end of the guide rod 86*r* may be received in a recess formed in a lower face of the lower body section 83*b* and a lower end of the guide rod may be received in a recess formed in an upper face of the shoe 89, thereby connecting the guide rod to the body 83 and the shoe 89. A bearing may be received in a second recess formed in the shoe upper face and the bearing may receive a lower end of the lead screw 85, thereby supporting the lead screw for rotation relative to the body 83 and shoe 89.

The cam 88 may be tubular and have a conical inner surface. The cam 88 may have passages formed therethrough for receiving the lead screw 85 and the guide rod 86*r*. The lead nut 84 may be received in a recess formed in an upper face of the cam 88 and fastened or interference fit thereto, thereby connecting the lead nut to the cam. The lead nut 84 may be engaged with the lead screw 85 such that rotation of the lead screw by the motor 81 causes longitudinal displacement of the cam 88 relative to the body 83 and seat 90 between an upper position (FIG. 4C) and a lower position (shown). The cam 88 may rest against the shoe 89 in the lower position for supporting a piston force exerted thereon when the ball 43*b* is seated (FIG. 4B). The cam 88 may also have one or more (two shown) threaded sockets formed in the upper face thereof for receiving respective threaded fasteners, thereby connecting the guide ring 86*g* thereto. The guide ring 86*g* may have one or more (two shown) keys formed in an inner surface thereof. Each guide key may be engaged with a respective slot formed in an outer surface of the upper mandrel section 87*u*, thereby torsionally connecting the cam 88 to the body 83 while providing longitudinal freedom relative thereto.

Figure 4A:
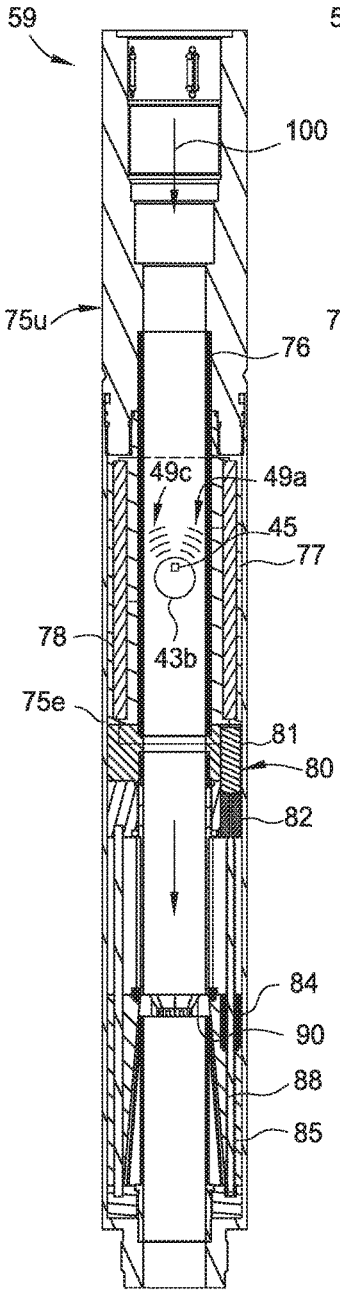
FIGS. 4A-4C illustrate operation of the ball release system.
Figure 4B:
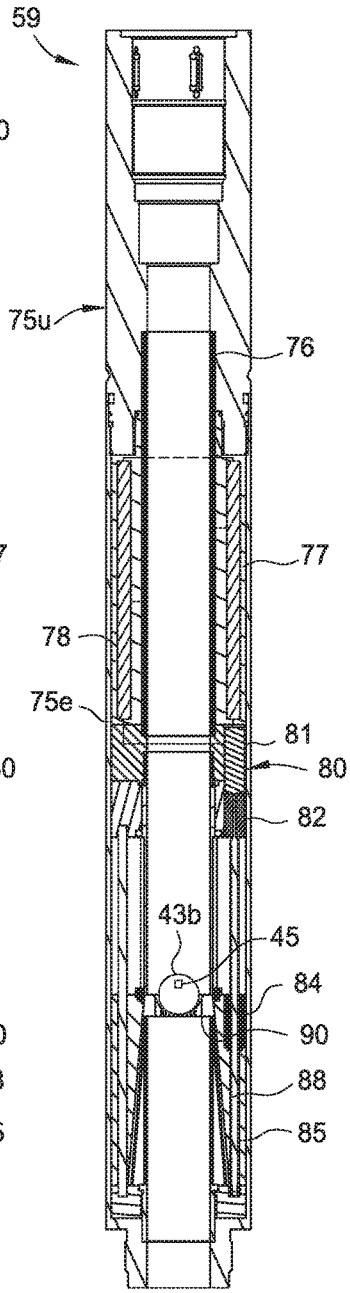
Figure 4C:
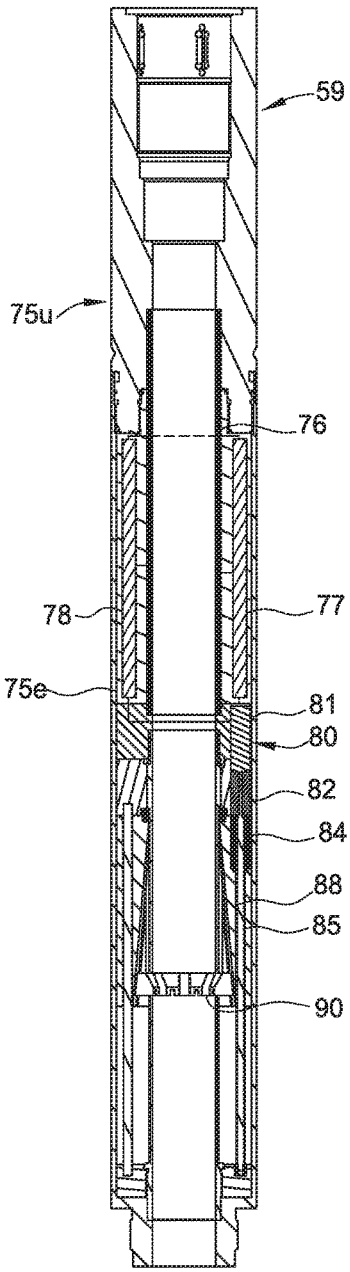

The ball seat 90 may include a plurality (four shown) of arcuate segments 90*s* radially movable relative to the body 83 between a catch position (shown) and a release position (FIG. 4C). Each segment 90*s* may be disposed between a lower end of the upper mandrel 87*u* and an upper end of the lower mandrel 87*b*, thereby longitudinally connecting the seat 90 to the body 83 while proving radial freedom relative thereto. Each segment 90*s* may have an inclined outer surface complementary to the conical inner surface of the cam 88 and engaged therewith for radial movement of the seat 90 in response to longitudinal movement of the cam. Each segment 90*s* may also have a profile formed in the inclined outer surface thereof and the cam may have respective complementary profiles formed in the conical inner surface thereof for radially keeping and positively retracting the segments. The profiles may be a tongue and groove joint or dovetails and the segments 90*s* may have the male profile and the cam 88 may have the female profile or vice versa.

The segments 90*s* may be pressed together in the catch position to provide sealing integrity to the seat or may have a controlled gap therebetween. The segments 90*s* may each be made from an erosion resistant material, such as high strength steel, high strength stainless steel, a cermet, or nickel based alloy. The segments 90*s* may be flush with or clear of a bore of the ball release system 59 in the release position.

Once the ball 43*b* is caught and after a predetermined time, the ball seat 90 may be actuated radially outward via movement of the cam 88. Radially-outward actuation of the ball seat 90 allows the ball 43*b* to pass therethrough, thus reestablishing circulation to the LDA bore.

FIGS. 4A-4C illustrate operation of the ball release system 59. Once the liner string 15 has been advanced into the wellbore 24 by the workstring 9 to a desired deployment depth and the cementing head 7 has been installed, conditioner 100 may be circulated by the cement pump 13 through the valve 41 to prepare for pumping of cement slurry. The ball launcher 44 may then be operated and the conditioner 100 may propel the ball 43*b* down the workstring 9 to the plug release system 59. The tag 45 may transmit the command signal 49*c* to the antenna 74 as the tag passes thereby. The MCU may receive the command signal from the tag 45 and may start a timer. The ball 43*b* may then travel and land in the seat 90. Pumping may continue to increase pressure in the LDA bore/actuation chamber 71.

Once a first threshold pressure is reached, a piston of the liner hanger 15*h* may set slips thereof against the casing 25. Pumping may continue until a second threshold pressure is reached and the running tool 53 is unlocked. After a predetermined period of time, the MCU may operate the actuator 80 to release the ball 43*b*. The predetermined period of time may be selected to allow the first threshold pressure and second threshold pressure to be reached before releasing the ball 43*b*. Once released, the ball 43*b* may travel to a catcher (not shown) of the liner deployment assembly 9*d* or liner string 15.

Because the ball 43*b* is released from the ball seat 90 based on a signal from the electronics package 77, rather than at a particular pressure threshold, the likelihood of premature ball release and/or delayed ball release is reduced. In particular, the release of the ball 43*b* is no longer pressure dependent, but rather, is time dependent. Thus, the ball 43*b* is released at the proper time, and not before the first threshold pressure or the second threshold pressure is reached. The inclusion of the RFID tag 45 within the ball 43*b* allows the antenna 74 to detect the presence of the ball 43*b* immediately prior to placement in the ball seat 90. Therefore, the amount of time the ball 43*b* is present in the ball seat 90 can be accurately controlled by the electronics package 77, and the ball 43*b* can be released at the appropriate time. Moreover, because the ball 43*b* remains in the ball seat 90 for a sufficient amount of time, it is possible to observe a pressure isolation event from the surface.

Alternatively, the electronics package 77 may include a pressure sensor in fluid communication with the bore of the ball release system 59 (above the seat 90) and the MCU may operate the actuator 80 once a predetermined pressure has been reached (after receiving the command signal) corresponding to the second threshold pressure. Alternatively, the electronics package may include a proximity sensor instead of the antenna and the ball may have targets embedded in the periphery thereof for detection thereof by the proximity sensor.

After releasing the ball 43*b* from the ball seat 90, weight may then be set down on the liner string 15 and the workstring 9 rotated, thereby releasing the liner string 15 from the running tool 53. An upper portion of the workstring may be raised and then lowered to confirm release of the running tool. The workstring and liner string 15 may then be rotated 8 from surface by the top drive 5 and rotation may continue during the cementing operation. Cement slurry may be pumped from the mixer 42 into the cementing swivel 7*c* via the valve 41 by the cement pump 13. The cement slurry may flow into the launcher 7*p* and be diverted past the cementing plug 43*d* via the diverter and bypass passages.

Once the desired quantity of cement slurry has been pumped, the cementing dart 43*d* may be released from the launcher 7*p* by operating the actuator. Chaser fluid (not shown) may be pumped into the cementing swivel 7*c* via the valve 41 by the cement pump 13. The chaser fluid may flow into the launcher 7*p* and be forced behind the dart by closing of the bypass passages, thereby propelling the dart into the workstring bore. Pumping of the chaser fluid by the cement pump 13 may continue until residual cement in the cement discharge conduit has been purged. Pumping of the chaser fluid may then be transferred to the mud pump 34 by closing the valve 41 and opening the valve 6. The dart 43*d* may be driven through the workstring bore by the chaser fluid until the dart lands onto the cementing plug, thereby closing a bore thereof. Continued pumping of the chaser fluid may cause the plug release system 60 to release the cementing plug from the LDA 9*d*.

Once released, the combined dart and plug may be driven through the liner bore by the chaser fluid, thereby driving cement slurry through the float collar 15*c* and reamer shoe 15*s* into the annulus 48. Pumping of the chaser fluid may continue until the combined dart and plug land on the collar 15*c*, thereby releasing a prop of a float valve (not shown) of the collar 15*c*. Once the combined dart and plug have landed, pumping of the chaser fluid may be halted and workstring upper portion raised until the setting tool 52 exits the PBR 15*r*. The workstring upper portion may then be lowered until the setting tool 52 lands onto a top of the PBR 15*r*. Weight may then be exerted on the PBR 15*r* to set the packer 15*p*. Once the packer has been set, rotation 8 of the workstring 9 may be halted. The LDA 9*d* may then be raised from the liner string 15 and chaser fluid circulated to wash away excess cement slurry. The workstring 9 may then be retrieved to the MODU 1*m*.

Additionally, the cementing head 7 may further include a bottom dart and a bottom wiper may also be connected to the plug release system 60. The bottom dart may be launched before pumping of the cement slurry.

Alternatively, the RFID tag 45 may not be included within the ball 43*b*, and instead, may be pumped downhole prior to the ball 43*b* to indicate that the ball 43*b* is about to be deployed. Alternatively, the actuator 80 may be hydraulic instead of electric and include a pump instead of the lead screw and nut. The cam may then be part of a piston driven by the pump.

Alternatively, the ball release system 59 may be utilized with a hydraulically-operated downhole tool. The ball release system 59 and the hydraulically-operated downhole tool may be deployed into the wellbore using a deployment string (e.g., drill pipe or coiled tubing) while the ball release system 59 is in the release position. A first command signal may be sent by pumping a first tag through the ball release system 59 to move the ball release system 59 to the catch position. A ball having an RFID tag therein may then pumped to the seat, the tool is operated, and the ball is released.

Figure 5:
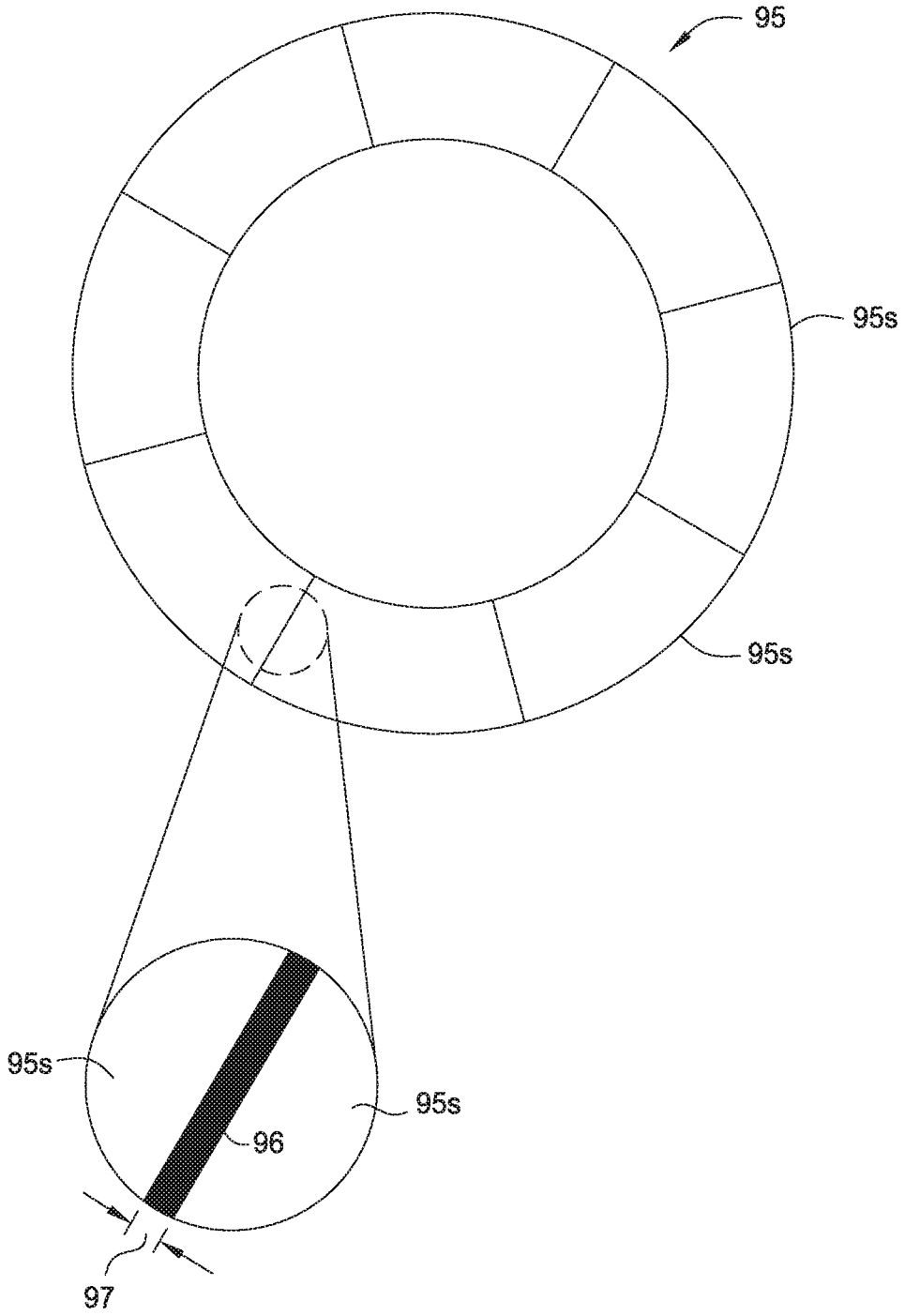
FIG. 5 illustrates an alternative seat for the ball release system, according to another embodiment of this disclosure.

FIG. 5 illustrates an alternative seat 95 for the ball release system 59, according to another embodiment of this disclosure. The ball seat 95 may include a plurality (eight shown) of arcuate segments 95*s* radially movable relative to the actuator body between a catch position (shown) and a release position (not shown). To facilitate sealing integrity with the ball 43*b*, the segments 95*s* may initially be bonded together in the catch position by a sealant 96. The sealant 96 may be a polymer and may be applied to fill interfaces 97 formed between adjacent segments 95*s* by molten injection molding or reaction injection molding. The sealant 96 may be selected to have a shear strength sufficient to prevent extrusion from each interface 97 while the threshold pressures are exerted on the seated ball 43*b* and a tensile strength weak enough for tearing apart to accommodate the cam radially retracting the segments 95*s* to the release position. The sealant 96 may be a more brittle polymer, such as a thermoset, to ensure tearing instead of plastic stretching.

Alternatively, the sealant 96 in each interface 97 may be pre-weakened, such as by scoring, to facilitate tearing. Alternatively, the sealant 96 may be a thermoplastic polymer and may plastically stretch instead of tearing. Alternatively, the sealant 96 may be an elastomer or elastomeric copolymer having sufficient elasticity to expand to the release position without tearing or plastic stretching such that the ball release system may be re-actuated to catch a second (or more) ball. Alternatively, each segment 95*s* may be coated with the (elastomeric) sealant to seal the interfaces 97 by engagement of the coated surfaces in the catch position.

Alternatively, the ball release system may include a flapper made from the (elastomeric) sealant material which is released over the seat in response to receipt of the command signal and before landing of the ball. The ball may then squeeze the flapper into the seat to seal the interfaces 97.

While the foregoing is directed to embodiments of the present disclosure, other and further embodiments of the disclosure may be devised without departing from the basic scope thereof, and the scope of the invention is determined by the claims that follow.

The invention claimed is:

1. A catch and release system for catching and releasing an object in a wellbore, comprising:

a tubular housing;

a seat disposed in the tubular housing and movable between a catch position for receiving an object and a release position;

a cam disposed in the tubular housing, longitudinally movable relative thereto, and operable to move the seat from the catch position to the release position; and an electronics package disposed in the tubular housing, comprising:

a pressure sensor configured to monitor a pressure in a bore of the tubular housing, wherein the seat is movable to the release position at a predetermined pressure.

2. The catch and release system of claim 1, further comprising an actuator operable to move the cam.

3. The catch and release system of claim 2, wherein the actuator further comprises:

a shaft at least partially disposed in the cam; and a motor configured to rotate the shaft relative to the cam.

4. The catch and release system of claim 2, wherein the electronics package is configured to operate the actuator in response to receiving a command signal.

5. The catch and release system of claim 1, wherein the object includes a wireless identification tag configured to transmit a command signal.

6. The catch and release system of claim 5, further comprising an antenna disposed in the tubular housing and configured to receive the command signal from the object.

7. The catch and release system of claim 5, wherein the wireless identification tag is a radio frequency identification tag.

8. The catch and release system of claim 1, wherein the cam is longitudinally movable relative to the seat.

9. The catch and release system of claim 1, wherein the pressure sensor is in fluid communication with the bore of the tubular housing above the seat.

10. The catch and release system of claim 1, wherein the seat is radially movable relative to the bore of the tubular housing.

11. The catch and release system of claim 1, wherein the actuator further comprises a tubular mandrel disposed in the tubular housing, the tubular mandrel configured to restrict longitudinal movement of the seat relative to the tubular housing.

12. The catch and release system of claim 1, the seat comprising segments configured to form a ring in the catch position.

13. A method of hanging an inner tubular string on an outer tubular string, comprising:

running the inner tubular string and a deployment assembly into a wellbore using a deployment string, wherein the deployment assembly comprises a catch and release system for catching and releasing an object in a wellbore;

pumping an object down the deployment string to a seat of the catch and release system;

increasing pressure in a bore of the deployment assembly to hang the inner tubular string on the outer tubular string; and moving the seat of the catch and release system with a cam to release the object in response to reaching a predetermined pressure.

14. The method of claim 13, further comprising monitoring the pressure in the bore of the deployment string.

15. The method of claim 13, further comprising sending a command signal to the catch and release system from the object.

16. The method of claim 13, wherein the object includes a wireless identification tag.

17. A method of operating a catch and release system in a wellbore, comprising:

landing an object in a seat of the catch and release system;

increasing pressure in a bore of the catch and release system to hang an inner tubular string on an outer tubular string;

monitoring the pressure in the bore of the catch and release system with a pressure sensor; and moving the seat of the catch and release system with an actuator having a cam from a catch position to a release position to release the object in response to detecting a predetermined pressure.

18. The method of claim 17, further comprising sending a command signal to the catch and release system from the object.

19. The method of claim 17, wherein the object includes a wireless identification tag.

20. The method of claim 17, further comprising sending a signal from an electronics package of the catch and release system to operate the actuator of the catch and release system.

* * * * *